US007500294B2

(12) United States Patent
Schweizer et al.

(10) Patent No.: US 7,500,294 B2
(45) Date of Patent: Mar. 10, 2009

(54) WATER NEEDLING DEVICE

(75) Inventors: Roland Schweizer, Leonberg (DE); Thomas Weigert, Sulzbach (DE)

(73) Assignee: Fleissner GmbH, Egelsbach (DE)

( * ) Notice: Subject to any disclaimer, the term of this patent is extended or adjusted under 35 U.S.C. 154(b) by 0 days.

(21) Appl. No.: 11/664,757

(22) PCT Filed: Sep. 10, 2005

(86) PCT No.: PCT/EP2005/009758

§ 371 (c)(1),
(2), (4) Date: Apr. 4, 2007

(87) PCT Pub. No.: WO2006/039970

PCT Pub. Date: Apr. 20, 2006

(65) Prior Publication Data

US 2007/0261220 A1 Nov. 15, 2007

(30) Foreign Application Priority Data

Oct. 7, 2004 (DE) ..... 10 2004 049 146

(51) Int. Cl.
*D04H 1/46* (2006.01)

(52) U.S. Cl. ..... 28/167; 28/104

(58) Field of Classification Search ..... 28/104, 28/167, 105; 226/91; 242/125, 125.1, 125.3, 242/908, 397, 397.5, 615, 615.1, 615.2; 68/201, 68/204, 205 R, 205 E; 162/283
See application file for complete search history.

(56) References Cited

U.S. PATENT DOCUMENTS 2,862,251 A * 12/1958 Kalwaites ..... 264/119
4,111,122 A 9/1978 Kutzner ..... 101/228
4,747,254 A 5/1988 Lancaster ..... 53/556
5,791,028 A * 8/1998 Zolin ..... 26/1
5,881,440 A * 3/1999 Deeming et al. ..... 28/104
5,960,525 A * 10/1999 Fleissner ..... 28/104
6,058,583 A * 5/2000 Takeuchi et al. ..... 28/104
6,321,425 B1 * 11/2001 Putnam et al. ..... 28/104
6,375,773 B1 * 4/2002 Andersen ..... 156/148
6,412,155 B2 * 7/2002 Fleissner ..... 28/104
6,840,171 B2 * 1/2005 Fuchs et al. ..... 101/228

FOREIGN PATENT DOCUMENTS

EP 1462557 9/2004
WO WO 96/09426 A1 * 3/1996

* cited by examiner

*Primary Examiner*—Amy B Vanatta
(74) *Attorney, Agent, or Firm*—Andrew Wilford

(57) ABSTRACT

A water needling device has a housing having an intake side and defining a generally horizontal transport direction extending downstream from the intake side. A support in the housing has an upwardly directed foraminous support face. Upstream and downstream reversible winders in the housing spaced apart in the direction flank a plurality of rollers. A textile web passesin the housing along a path starting at the intake, extending over the support face and the rollers, and then downstream out of the housing. A nozzle beam is directed downward at the surface to consolidate the web as it passes over the foraminous face. A threading-in conveyor strand secured to the winders and having a gripper attachable to the textile web extends over at least some of the rollers. This strand is attached at its ends to reversible winders.

9 Claims, 1 Drawing Sheet

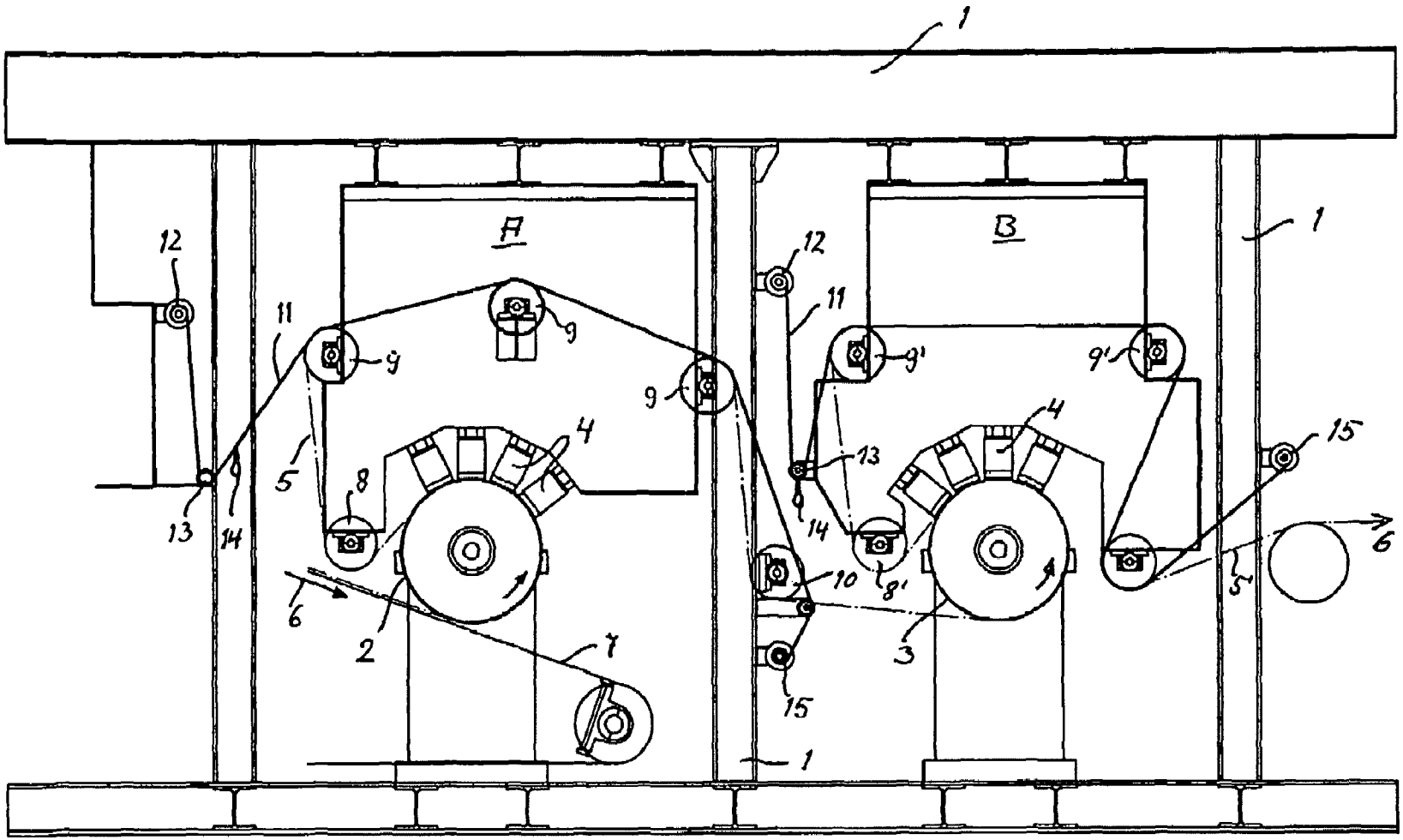
1
1
1
1
B
A
2
3
4
4
5
5
6
6
7
8
8'
9
9
9'
9'
10
11
11
12
12
13
13
14
14
15
15

WATER NEEDLING DEVICE

CROSS REFERENCE TO RELATED APPLICATIONS

This application is the U.S. national phase of PCT application PCT/EP2005/009758, filed 10 Sep. 2005, published 20 Apr. 2006 as WO 2006/039970, and claiming the priority of German patent application 102004049146.1 itself filed 7 Oct. 2004, whose entire disclosures are herewith incorporated by reference.

BACKGROUND OF THE INVENTION

A hydrodynamic needling device is generally known for consolidation or finishing of fibers of textile webs guided continuously through a device having rollers mounted in a housing and transporting the textile web and optionally endless belts. At least one nozzle beam extends therein transversely over the working width on a side opposite the support faces. This nozzle beam has an upper portion with a pressure chamber extending over its length and to which liquid is supplied under pressure, for example, at its end. A partition extending parallel to the pressure chamber and formed with throughgoing holes defines a pressure-distribution chamber. A nozzle sheet is mounted liquid-tight manner on the lower portion, provided with orifices for the nozzles. The pressure distribution chamber runs out into a slot opening out onto the nozzle orifices of the nozzle sheet from which jets are directed toward the textile web and onto a foraminous support face under which is a with a water suction device. Further deflecting rollers guide the textile web opposite to the direction of transport, and guide the textile web around the water needling device. The usual endless belts arranged there or the actual needling drums are self-threading for the new textile web to be taken in, the textile web merely needs to be laid on the respective roller and then the web should be further transported automatically. However, there are also devices of this type which are not only very large in their height dimensions so that an operator can no longer reach the individual textile web conveying elements and/or the textile web can have a width which can only be manipulated with difficulty. Several persons must assist with threading in the textile web and they must climb to the necessary insertion height by means of a frame.

OBJECT OF THE INVENTION

It is the object of the invention to develop a device whereby a textile web can be laid automatically, substantially without the assistance of an operator over individual rollers or over all the deflecting rollers.

SUMMARY OF THE INVENTION

Starting from the device described above, this object is achieved in that for starting the device an auxiliary material-web drawing-in device is provided for drawing in the textile web over the individual rollers of the entire device or only individual parts of the device. The threading-in device can have its own design independently of the elements of the needling device or it can be mounted on the rollers provided in any case for guiding the textile web. Appropriately, merely a one-dimensional conveyor is used for threading-in, this conveyor being driven forward for threading-in with a securing device for the textile web and then being pulled reversibly back again for taking in for a new application.

BRIEF DESCRIPTION OF THE DRAWING

A device of the type according to the invention is shown as an example in the drawing. The sole FIGURE shows a water needling device with two needling stations and two threading-in devices.

SPECIFIC DESCRIPTION

According to the example, two needling stations A and B are formed in a housing 1. They each consist of a foraminous screen drum 2 or 3 that rotate counterclockwise. A plurality of nozzle beams 4 are radially juxtaposed above each of the first and second screen drums 2, 3 and fixed in the housing 1. Suction devices, not shown here, are provided inside the screen drums 2 and 3 in line with nozzle jets leaving the nozzle beams 4.

A textile web 5 enters the needling device in the direction of the arrow 6 in the material transport direction and specifically lying on an endless belt 7 whose upper reach bears tangentially against the underside of the first screen drum 2. The textile web 5 then loops around the screen drum 2 by more than 180° and is deflected upward by a deflecting roller 8 level with the intake. Three further deflecting rollers 9 are mounted rotatably in the housing 1 above the screen drum 2 and serve to deflect and convey the textile web 5 back in the direction 6 of material transport again. This is followed by an identical needling station B with the screen drum 3 that in this embodiment again rotates counterclockwise and on which the face of the textile web 5 that has already been needled is again exposed to the nozzle jets. This is followed by similarly arranged deflecting rollers 8' and 9' above the screen drum 3, the rollers 9' being rotatably mounted in order to be able to convey the needled textile web 5 out of the device in the direction of transport 6.

In the illustrated embodiment, the screen drums 2, 3 are arranged at the working level of the operator. Thus, threading in the textile web 5 is easily effected there. Otherwise, the return of the textile web from the deflecting roller 8 over the rollers 9 toward an intake roller 10 is now again at the height of the second screen drum 3 on which the textile web 5 can again be grasped by the operator. The rollers 9 are relatively inaccessibly mounted in the housing 1 far above the reach of the operator depending on the overall size of the device. For this reason, in this embodiment a threading-in device is only shown for the upper deflecting rollers 9.

A similar or differently constructed threading-in device can also be installed for threading the textile web into the entire needling device with the stations A and B. This could be automatic or semi-automatic. A fully automatic threading-in device could consist of a leader strip that is secured upstream of the needling device by an additional water needling beam to the textile web across its full width and that then guides the textile web by means of cables, by means of cables which grip and guide the leader strip like scissors, around all the rollers, deflecting rollers, along the belts or the like precisely like the textile web guides provided for needling and can even thread the textile web into the drier which usually follows.

A transfer band, a chain or a cable can be used for drawing in the textile web. For driving these elements for drawing in the textile web it is important to thread in the textile web at constant torque, at constant tensile force. This can be done manually, using an electric or pneumatic motor, using a rotating magnet or using torsion springs.

In the present case, a reversible conveyor strand 11 is provided for threading in the textile web 5 with reversibly a drivable upstream winder 12 mounted level with the deflecting rollers 9 in the housing 1, from which the conveyor strand 11, such as a cable, for example, is guided downward around a deflecting roller 13 mounted level with the screen drum 2. A detachable gripper 14 for the textile web 5 to be drawn in is provided there in the upward-running stretch of the conveyor strand 11, this device being shown here as a cable loop. Any other fixing such as a previously made connection of the textile web optionally with for example a leader strip, Velcro closure, a simple hook, eye or similar elements can be used here. In any case, the textile web 5 to be drawn in is secured to the conveyor strand and is drawn over the deflecting rollers 9 by the pull of the conveyor strand by a reversible downstream winder 15 below the delivery roller 10.

After disconnecting the textile web from the conveyor 11 level with the intake roller 10, the textile web 5 is gripped by the operator again and is guided around the second screen drum 3 of the following needling station B. The same threading-in device with the same mode of operation is provided for this following needling station. which is why the same reference numerals are used in the drawing.

The textile web can have a narrow width but also a large width of more than 5 m. For large widths it is advantageous to reduce the width of the textile web at its leading end. The conveyor strand 11 provided here is arranged on one side of the rollers 2, 3, 8, 9, 10 and is guided there in a small broadening of the roller oil its outer circumference.

The invention claimed is:

1. A water needling device comprising:

a housing having an intake side and defining a generally horizontal transport direction extending downstream from the intake side;

a support in the housing having an upwardly directed foraminous support face;

upstream and downstream reversible winders in the housing spaced apart in the direction;

a plurality of rollers in the housing between the winders;

means in the housing defining for a textile web a path starting at the intake, extending over the support face and the rollers, and then downstream out of the housing;

means including a nozzle beam directed downward at the surface for projecting a plurality of high-pressure water streams at the textile web and thereby consolidating and finishing it as it passes over the foraminous face;

a threading-in conveyor strand secured to the winders, having a gripper attachable to the textile web, and extending over at least some of the rollers; and means for operating the winders in a forward direction for, when the gripper is attached to a leading end of the web, pulling the web over the rollers and through the housing and for, when the gripper is not attached to the web, operating the winders in a reverse direction to return the gripper upstream.

2. The device defined in claim 1, further comprising a leader attached to a leading end of the textile web and attachable to the gripper.

3. The device defined in claim 1 wherein the support is a screen drum mounted in the housing and below the rollers.

4. The water needling device defined in claim 1 wherein the nozzle comprises a) an upper portion with a pressure chamber arranged over its length, to which pressurized liquid is supplied, b) a pressure distribution chamber with an intermediate wall parallel thereto, which is connected to the pressure chamber via liquid through-holes disposed in the intermediate wall, and c) a nozzle sheet mounted in a liquid-tight manner on the lower portion and provided with orifices for the nozzles, the pressure distribution chamber being provided on the area opposite to the liquid through-holes with a slot which opens out onto the nozzle orifices of the nozzle sheet and from which the nozzle jets are directed toward the web and onto the support face provided with a water suction device.

5. The device according to claim 1 wherein winders when operating in the forward direction operate synchronously with rollers.

6. The device according to claim 1, wherein the conveyor strand is carried by the rollers.

7. The device according to claim 2 wherein the leader is connected to the material web by water needling.

8. The device according to claim 1 wherein the conveyor strand is guided so that it cannot be displaced laterally on the rollers.

9. The device according to claim 1 wherein the gripper is a loop in or on the conveyor strand.

* * * * *